United States Patent [19]

Collis

[11] Patent Number: 4,493,125

[45] Date of Patent: Jan. 15, 1985

[54] TOOTHBRUSH WITH CURVED BRISTLES

[76] Inventor: George C. Collis, 313 W. 48th St., Minneapolis, Minn. 55409

[21] Appl. No.: 474,805

[22] Filed: Mar. 14, 1983

Related U.S. Application Data

[63] Continuation-in-part of Ser. No. 175,424, Aug. 5, 1980, Pat. No. 4,382,309.

[51] Int. Cl.[3] ..... A46B 9/04

[52] U.S. Cl. ..... 15/167 A; 15/110

[58] Field of Search ..... 15/167 R, 167 A, 110; 128/62 A

[56] References Cited

U.S. PATENT DOCUMENTS

| | | | |
|---|---|---|---|
| 796,980 | 8/1905 | Andrews | 15/143 R |
| 2,317,485 | 4/1943 | Rider | 15/167 R |
| 2,876,477 | 3/1959 | Stewart | 15/159 R X |
| 4,382,309 | 5/1983 | Collis | 15/110 X |

FOREIGN PATENT DOCUMENTS

| | | | |
|---|---|---|---|
| 2449513 | 4/1976 | Fed. Rep. of Germany | 15/167 R |

*Primary Examiner*—Peter Feldman
*Attorney, Agent, or Firm*—Robert R. Keegan

[57] ABSTRACT

There is disclosed a toothbrush with curved bristles formed of natural or manmade fibers of thermoplastic or thermosetting material such as acetate fibers, rayon fibers, acrylic fibers, nylon fibers, polyamide resins, polyimide resins, phenolic resins, or urea resins; the bristles are set in two rows, at least one of the rows being offset from the center-line of the brush and with a curvature which is concave viewed from the center-line of the brush; some embodiments have bristles with substantially uniform curvature and other embodiments have bristles wherein the curvature in non-uniform and the greatest curvature is approximately one-third of the length from the distal extremity of the bristle. Preferably the bristle distal extremities are at about a right angle to the proximal bristle portion and the brush optionally has a row of short straight bristles parallel to the row of curved bristles on the concave curvature side of the curved bristles. In one embodiment the cross section of the bristles is triangular or other polygonal shape and approximately half of the bristles at the outer end portions of the bristle row are longer than others of the bristles and extend a greater distance from the bristle mounting face. A bush handle has a generally circular cross section and is slightly flattened on one side to facilitate controlled rotation of the brush about its longitudinal axis; the handle has circumferential grooves for better gripping action.

19 Claims, 15 Drawing Figures

TOOTHBRUSH WITH CURVED BRISTLES

This application is a continuation-in-part of George C. Collis' Application Ser. No. 175,424 filed Aug. 5, 1980 for Toothbrush, now U.S. Pat. No. 4,382,309.

The present invention relates to toothbrushes and particularly toothbrushes with at least a portion of the bristles shaped in the form of a curve and arranged such that some of the bristle ends are at an angle of 90° or 180° approximately with the ends of other bristles of the toothbrush. One may thus use the toothbrush in a conventional fashion and yet brush two or more distinctly different surfaces of the teeth at the same time, or in any event without reorienting the handle of the toothbrush.

In one preferred embodiment of the invention the bristle mounting portion of the brush is an extension of the brush handle and there are three rows of bristles extending longitudinally on the bristle mounting head; the two outer rows of bristles are curved toward each other so that their ends meet or nearly meet while a substantially shorter central row of bristles is straight. Using the brush with a conventional horizontal reciprocating motion with the short straight bristles cleaning the crown portion of the teeth will at the same time cause one of the curve row of bristles to clean the outside (buccal) surface of the teeth and the other curved row of bristles to clean the inside (lingual) surface of the teeth.

In a preferred embodiment the handle is of circular cross section with a small flattened portion to improve the facility with which the toothbrush can be manipulated between the thumb and fingers of the user. One embodiment of the toothbrush includes two lengths of curved bristles, a section of longer bristles near the end of the toothbrush facilitates cleaning the larger molars. In this embodiment the cross section of the curved bristles is square.

The general objective, namely brushing two or more distinctly different surfaces of the teeth at one time or with one brush orientation has been pursued previously, for example in Collis U.S. Pat. No. 3,903,906 issued Sept. 9, 1975, for Method and Apparatus for Brushing Teeth and in Collis U.S. Pat. No. 3,984,890 issued Oct. 12, 1976, for Electric Toothbrush. The latter patent involves the use of bristles arranged in a circle on a spindle and apart from the over-all objective is not material to the structure of apparatus according to the present invention. U.S. Pat. No. 3,903,906, although the brush therein is not electrically driven, also has a disclosure of a brush with bristles in a circular arrangement mounted on a spindle; in this respect it provides a teaching, directed away from rather than toward the apparatus of the present invention. West Germany Pat. No. 2,449,513 to Collis has the disclosure of U.S. Pat. No. 3,903,906 and a flathead, chewing action brush with straight, inwardly slanting bristles. U.S. Pat. No. 3,100,309 to Gambino issued Aug. 13, 1963 for "Toothbrush" employs curved bristles in a toothbrush but both the structure and purpose are quite different from that of apparatus according to the present invention. In Gambino the bristle rows are mounted on a head which is perpendicular to the handle, and it is neither intended nor possible to utilize the bristles to brush distinctly different surfaces of the teeth at the same time. These and other references cited in the parent co-pending application are marginally relevant, but they fail to show the features of the apparatus according to the present invention and are incapable of carrying out the purpose of this apparatus.

In addition to providing the objects and advantages mentioned above it is an object of the present invention to provide a toothbrush with at least two rows of bristles, one of which is a row of curved bristles with the distal ends of the bristles extending at approximately a right angle to the proximal ends of the bristles which are embedded in the bristle mounting head of the toothbrush.

It is another object of the present invention to provide a toothbrush with two rows of curved bristles with the concave curvature of the bristle rows facing each other and the tops of the bristle of the respective rows touching or nearly touching one another.

It is still another object of the present invention to provide a toothbrush which is capable of simultaneously brushing the inside (lingual) and outside (buccal) surfaces of the teeth without reorienting the toothbrush handle and which is easy and economical to manufacture and lends itself to mass production.

It is a further object of the present invention to provide a toothbrush with curved bristles and a handle of circular cross section such that the handle may be gripped between the thumb and fingers and readily rotated to bring the bristles to the desired orientation, thus making the brush especially desirable in dental hygiene for disabled persons or invalids. It is a still further object of the present invention to provide a toothbrush with curved bristles which have a triangular or other polygonal cross section thereby enhancing the cleaning action of the shanks of the curved bristles as they come in sliding contact with the tooth surfaces.

Other objects and advantages of the present invention will be apparent from consideration of the following description in conjunction with the appended drawings in which.

Figure 5:
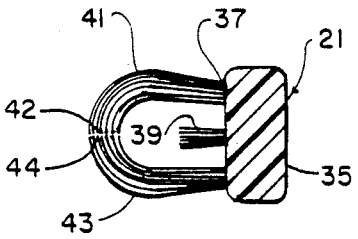
FIG. 5 is an enlarged sectional view of the toothbrush of FIG. 1 taken along the line 5—5 in FIG. 1.

Referring now to the drawings and particularly FIGS. 1 through 6, a toothbrush 21 is shown having a handle 23 formed of molded plastic material with a conventional hole 25 for hanging the toothbrush.

Figure 3:
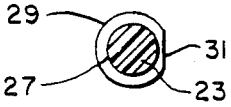
FIG. 3 is an enlarged sectional view of the toothbrush of FIG. 1 taken along the line 3—3 in FIG. 1.
Figure 2:
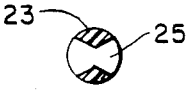
FIG. 2 is an enlarged sectional view of the apparatus of FIG. 1 taken along the line 2—2 in FIG. 1.
Figure 1:
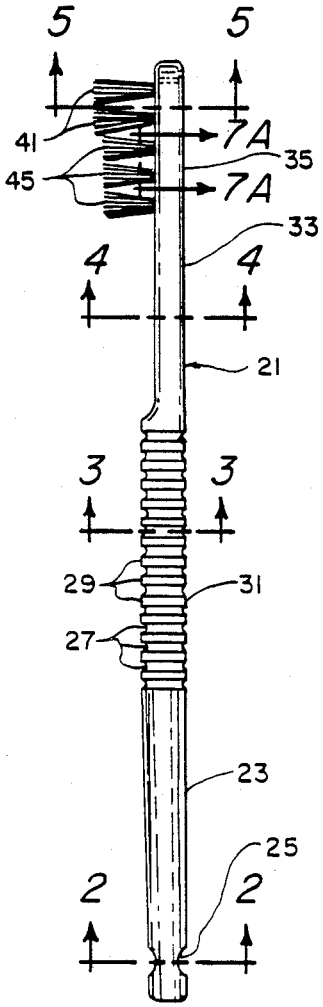
FIG. 1 is a side elevational view of a toothbrush with curved bristles in accordance with the present invention.

Handle 23 is preferable of generally circular cross section as shown in FIGS. 2 and 3 and is provided with grooves 27 causing the formation of ribs 29 which extend peripherally around the toothbrush 21. The back of the handle of the toothbrush is flattened slightly as shown at 31. The cross section of the toothbrush may be described as generally circular cross section with a segment of about 60° removed or might also be described as a cross section in the form of a circular segment of about 300°.

The grooves 27 and ribs 29 enable one to firmly grip the toothbrush handle 23 even though the fingers or the brush handle be wet and the generally circular cross section permits the brush handle to be rotated and manipulated readily between the thumb and fingers. The flat portion 31 provides tactile feedback to the user to aid in orienting the bristles. This is particularly useful when the brush is being used by a nurse or other attendant to clean the teeth of an invalid or partially disabled person.

Figure 4:
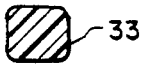
FIG. 4 is an enlarged sectional view of the toothbrush of FIG. 1 taken along the line 4—4 in FIG. 1.

The shank 33 of the toothbrush is of rectangular cross section as shown in FIG. 4 and is generally conventional. The bristle mounting head 35 is also generally conventional and has mounted therein novel bristles in tufts 41, 43, 45, and 47. The bristles and bristle tufts 41 and 43 near the end of the toothbrush are longer and of larger radius of curvature than the bristle tufts 45 and 47. Short straight bristles 39 are located in tufts between bristle tufts 41 and 43 and between bristle tufts 45 and 47. Bristles 39, 41, 43, 45 and 47 may be of conventional form (except for cross sectional shape) and may be produced from thermoplastic or thermosetting materials including but not limited to acetate fibers, acrylic fibers, nylon fibers, polyamide resins, polyimide resins, phenolic resins or urea resins. Preferably the bristle material will retain its resiliency and shape at temperatures up to at least 200° F.

Figure 6:
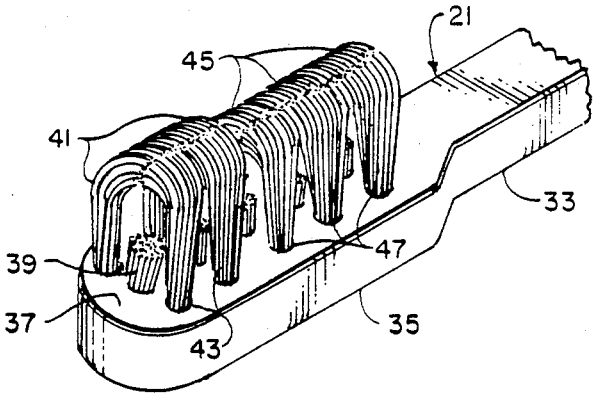
FIG. 6 is a fragmentary enlarged isometric view of the toothbrush of FIG. 1 showing the bristle arrangement on the bristle mounting head.

As shown in FIGS. 5 and 6 the bristles 41, 43, 45 and 47 are imbedded in the bristle mounting head 35 and preferably slant slightly outwardly from the center of bristle mounting head 37 where they emerge from bristle mounting face 37. The sharpest curvature of the bristles 41, 43, 45 and 47 in the embodiment illustrated in FIGS. 1 through 6 is in approximately the upper one-third of the bristle length and the ends of the bristles 42 and 44 meet or nearly meet at a center plane extending perpendicularly from the bristle mounting face 37.

Figure 7A:
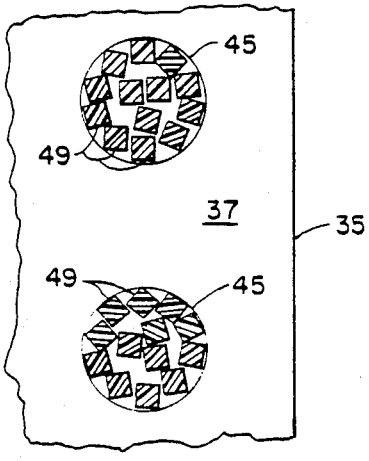
FIG. 7A is an enlarged fragmentary view of the toothbrush of FIG. 1 taken along the line 7A—7A in FIG. 1.

As shown in FIG. 7A the bristles 49 of bristle tufts 45 (and the other curved bristles of tufts 41, 43, and 47) have a cross section in the form of a polygon and specifically a square cross section in FIG. 7A. It is intended that in use the brush will be oriented to cause the curved bristle tufts 41 and 43 and curved bristle tufts 45 and 47 to straddle the individual teeth and particularly the molars. Consequently the bristles will contact the teeth not only at the ends 42 and 44 but also at the lower portions or shanks of the bristles. The square cross section bristles 49 provide far greater cleaning action as their shanks brush over the teeth than would be accomplished with circular cross section bristles.

An alternative bristle cross section shape is shown in FIG. 7A wherein bristle tufts 45 have been replaced by bristle tufts 87 which have bristles of triangular cross section 89.

Figure 7B:
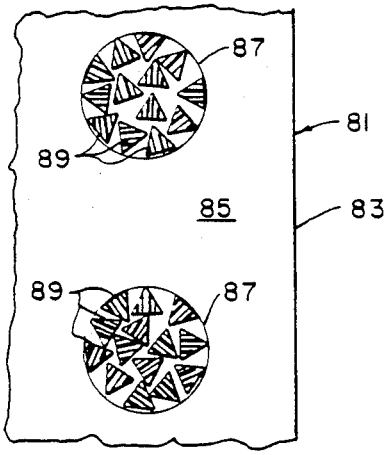
FIG. 7B is an enlarged view similar to 7A but with an alternative form of bristles of triangular cross section.

FIGS. 7A and 7B are somewhat schematic in that there is no attempt to show the exact number and orientation of the bristles. The bristles are preferably, oriented randomly rather being packed with maximum density; the number of bristles in the tuft may be from twenty to fifty and the dimension of the bristles cross section may be about 0.005 to 0.01 inches. The bristles may have another polygonal shape. Bristles with five edges (pentagonal cross section) will not close pack and inherently assume a random orientation. Bristles 49 and 89 may have ends 42 and 44 which are rounded or square cut or bias cut.

A primary advantage of the toothbrush according to the invention illustrated in FIGS. 1 through 7 is the fact that its use does not require any specialized technique to provide very good results. The brush 21 will commonly be used by applying the ends of short straight tufts 39 to the crowns or biting surfaces of the teeth and scrubbing with a reciprocating motion. As the brush is placed over the teeth the curved bristles 41, 43, 45 and 47 will part so that their ends 42, 44 are directed approximately perpendicular to the inside and outside tooth surfaces at or near the gum line. It may be noted that the curved bristles make it virtually impossible to apply excessive force to the gums with bristles ends 42 and 44. At the same time the bristle ends 42 and 44 are necessarily in gentle contact with the teeth and gums near the gum line for maximum effectiveness in cleaning this critical area.

The particular embodiment shown in FIGS. 1 through 7 with its bristles tufts of two different lengths is particularly adapted for users with mixed dentition, for example persons at an age of approximately six to ten years. The longer bristles 41 and 43 serve to brush the larger permanent molars at the rear of the dental arch while the shorter bristles 45 are especially adapted for the temporary teeth.

Numerous variations can be made to the specific embodiment of the invention shown in FIGS. 1 through 7. As previously mentioned the bristle tufts of two different heights are for a specialized application and the toothbrush will commonly be made with all bristle tufts of the same height. The brush 21 has three rows of five tufts each. This could be changed to three, four, or six tufts in each row. Furthermore the center row of tufts 39 could have fewer tufts than the outer rows or the center row could be eliminated entirely.

As shown hereinafter brushes according to the invention may have more than one row of tufts with curved bristles on each side of the bristle mounting head center line. In other cases, persons having extensive reconstructive dental work or other special problems may benefit by using a brush with one of the two rows of curved bristles shown in FIGS. 1 through 6 removed along with that portion of the bristle mounting head 35 in which such bristles would be mounted. In this case a brush would have for example only tufts 39 and 41 or 45 and the brush mounting head 35 would be substantially smaller. Persons with such problems would generally employ two brushes, one left-handed and one right-handed.

Of course brushes of the general character shown in FIGS. 1 through 6 may be made with bristle lengths and numbers of tufts per row suitable for the smaller mouths and dental arches of children and infants. While the tufts 39 may be made with polygonal cross section bristles such as shown in FIG. 7A and 7B there is little utility in such bristles for tufts 39 and they may alternatively be made of conventional circular cross section bristles. Tufts 41, 43, 45 and 47 may also be made of conventional circular cross section bristles if desired.

Figure 8:
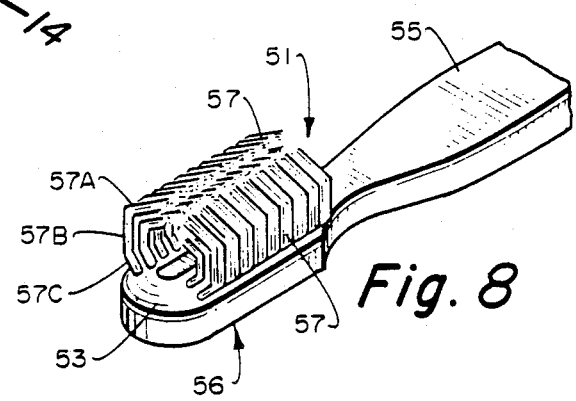
FIG. 8 is a perspective view of an alternative embodiment of the invention wherein the curved bristles have two sharp bends.

In FIG. 8 which illustrates an alternative embodiment, there is shown a brush 51 having a head 53 and handle 55 integrally formed with head 53. Emanating from each side of head 53 is a bundle of bristles 56 consisting of a plurality of individual bristles 57. These bristles 57 each have an outwardly extending portion 57A, a downwardly extending second portion 57B and an inwardly extending third portion 57C. Each portion 57C is spaced from and opposed to its correspondingly opposite member, such that both the lingual and buccal surfaces of a tooth may be simultaneously cleansed. The embodiment of FIG. 8 may be fashioned in the manner explained with reference to FIG. 12, except that further processing of the bristle bundles 56 is required to achieve the exact two bends in the individual filaments or bristle 57. Processing can be carried out by subjecting the bristles to deformation under steam in a mold of proper configuration.

Figure 9:
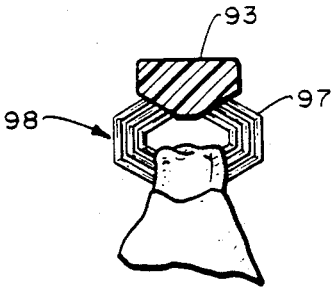
FIG. 9 is a front elevational view of a second alternative embodiment similar to the embodiment of FIG. 8 shown in use.

In FIG. 9 there is shown another embodiment of the improved toothbrush of this invention. In this embodiment, both surfaces of the tooth as previously discussed can be simultaneously cleaned. This embodiment differs from that of FIG. 8 only in the fact that the individual bristles 97 are collected into a plurality of tufts one of which 98 is seen on each side of head 93 in this front elevational view.

Figure 10:
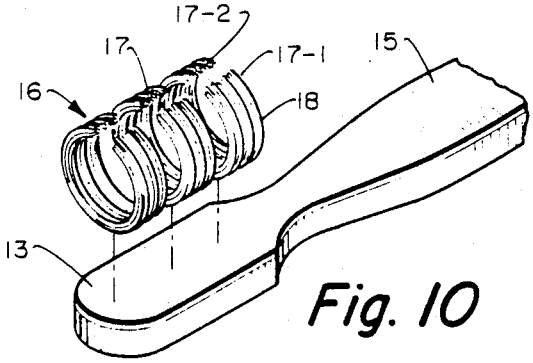
FIG. 10 is an exploded view of a third alternative form of toothbrush illustrating a method of manufacture.

As used herein, the term mono-bundle encompasses a brush head having two useable bundles of bristles, having one or more tufts, the bristles of which are joined at one end to an end of its correspondingly opposed bristle. A tuft is seen to be a plurality of individual bristles closely associated together at the lower ends and loose at their upper ends. In some embodiments of the prior co-pending application each of the two bundles forming the mono-bundle consisted of only one tuft. The use of a plurality of tuft construction is contemplated and could be constructed from two or more mandrel windings butted up to each other end to end. The winding, however, would not be in pure coil configuration, but would require overlapping of winds at one point to yield a tuft-like configuration. Reference is made to FIG. 10 which illustrates such a toothbrush in one exploded view to illustrate the winding mode.

In order to fashion such a pseudo-tufted mono-bundle, the winding over the mandrel as previously described must be overlapped along part of the extension of the winding such that the plurality of bristles 17 can have a common point of beginning.

Figure 11:
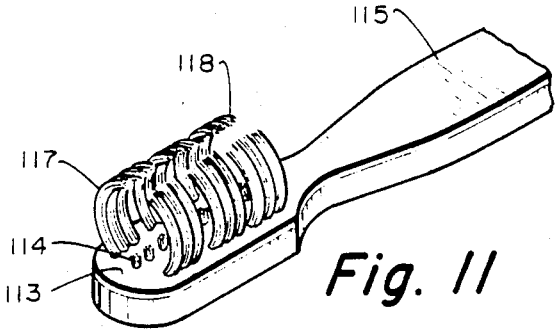
FIG. 11 is a top perspective view of a fourth alternative embodiment of the invention.

In FIG. 11, there is shown a top perspective view of an embodiment similar to that of FIG. 8 in that it uses a standard brush head 113 with bristles 117 in a plurality of tufts 118, said bristles being vertically disposed therein. As seen, the bristles 117 are arcuate in configuration and spaced apart from their corresponding opposite mirror image member. A smaller vertical tuft 114 is shown as optional tuft between the main tufts. A plurality of these are set out in a row spaced equidistantly from the tufts 118 that feature arcuate bristles 117. A standard handle 115 is molded with the head 113.

Figure 12:
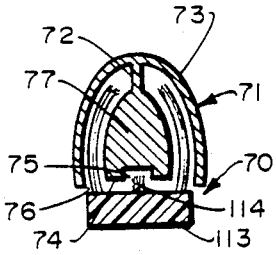
FIG. 12 is a sectional view illustrating a method of fabrication of the curved-bristle brush such as that shown in FIG. 11.

In FIG. 12, a mold 71 made of metal or plastic, capable of resisting high temperatures is shown superposed upon a brush 70, which prior to insertion into and treatment within the mold had straight vertical tufted bristles. The mold 71 has an outer arcuate portion 73 and an inner arcuate member 77 spaced apart from each other and held together by spacer member 72. The cavity defined between member 77 and portion 73, designated 76, confirms to the ultimately desired configuration for the bristles, here arcuate. Member 77 has two projecting spaced apart bosses 74, the distance between them being space 75 which allows for the disposition of tuft 114 therethrough. Space 75 can be eliminated if tuft 114 is not employed.

After the mold is affixed to position, and the tufts deformed, steam at about 200° F. to 300° F. is inserted into the mold to permanently form the bristles with the desired configuration, here arcuate. A mold such as 71 properly configured would be used to create the brush of FIG. 6 as well. Other techniques to fuse the bristles into a specific configuration can also be employed.

Figure 13:
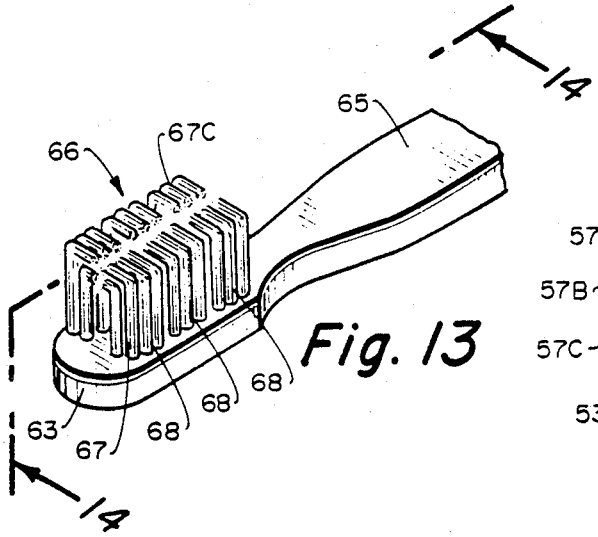
FIG. 13 is a top perspective view of a fifth embodiment of the invention similar to that shown in FIGS. 1 through 7 but having curved bristles with a sharp, nearly right angle, bend.
Figure 14:
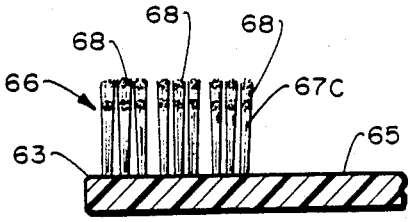
FIG. 14 is a sectional view taken along the line 14—14 in FIG. 13.

In FIG. 13 there is shown a top perspective view of a toothbrush in accordance with this invention wherein the angular bristles are set out in a plurality of tufts 68. The two bundles of bristles 66 are seen to be parallel at their point of origin in head 63 and spaced and opposed at the extreme portion of each bristle 67C. A space is maintained between the two rows of tufts forming the bundles. Optionally however, not shown, low vertical bristles, tufted or not may be disposed between the opposed bristle 67 to clean the biting surface of the tooth while the linguals and buccals are being cleaned. The tufting of the bristles 67 is better seen in FIG. 14 which is a sectional view of brush of FIG. 13 taken along line 14—14 in FIG. 13.

In addition to the variations and modifications to the invention shown or suggested above numerous other variations or modifications will be apparent to those skilled in the art and accordingly the scope of the invention is not to be considered limited to the particular embodiments shown, described, or suggested, but is rather to be determined by reference to the appended claims.

What is claimed is:

1. A toothbrush for brushing the buccal and lingual surfaces of teeth comprising an elongated handle, a bristle mounting head formed on the outer end of said handle having a bristle mounting face, and at least two rows of curved bristles, the proximal ends of said bristles being mounted in said bristle mounting face, the curved shape and mounting of said bristles being such that similarly positioned bristles in opposite bristle rows are symmetrically shaped and their distal extremities are nearly touching, the bristles at the outer end portions of said bristle rows being longer than others of the bristles and extending a greater distance from said bristle mounting face.

2. Apparatus as recited in claim 1 wherein at least some of said bristles have cross sections generally in the shape of a polygon with less than twelve sides.

3. Apparatus as recited in claim 1 wherein said bristles are set in tufts and the length of each row of bristle tufts is approximately one and one-half to two times the space between opposite bristle rows.

4. Apparatus as recited in claim 1 wherein said bristle mounting face is substantially planar and further including a row of shorter uncurved bristles between said rows of curved bristles.

5. Apparatus as recited in claim 1 wherein the greatest curvature of said bristles occurs at about one-third of the length from the distal extremity and the distal extremities are about at a right angle to the proximal bristle portion, each curved bristle lying approximately in a plane perpendicular to the longitudinal axis of said head.

6. A toothbrush for brushing the buccal and lingual surfaces of teeth in one operation comprising an elongated handle with a longitudinal axis, a bristle mounting head formed as an extension of said handle with a longitudinal axis at an angle of from 0° to 45° therewith and having a bristle mounting face, a row of short straight bristles, and a row of curved bristles on at least one side of said row of short straight bristles, the proximal ends of said bristles being mounted in said bristle mounting face and the bristle rows being substantially parallel to the longitudinal axis of said head, the greatest curvature of said curved bristles being at about one third of the length from the distal extremity and the bristle distal extremities being at about a right angle to the proximal bristle portions, their distal extremities approximately touching the extensions of said short straight bristles, the bristles at a distal end portion of said bristle rows being longer than others of the bristles and extending a greater distance from said bristle mounting face.

7. A toothbrush for brushing the buccal and lingual surfaces of teeth in one operation comprising an elongated handle with a longitudinal axis, a bristle mounting head formed as an extension of said handle with a longitudinal axis at an angle of from 0° to 45° therewith and having a bristle mounting face, a row of short uncurved bristles, a row of curved bristles on at least one side of said row of short uncurved bristles, at least some of said curved bristles having cross sections generally in the shape of a polygon with less than six sides, the proximal ends of said bristles being mounted in said bristle mounting face and the bristle rows being substantially parallel to the longitudinal axis of said head, the greatest curvature of said curved bristles being at about one third of the length from the distal extremity and the bristle distal extremities being at about a right angle to the proximal bristle portions, the bristles at one end of said bristle rows being longer than others of the bristles and extending a greater distance from said bristle mounting face.

8. Apparatus as recited in claim 7 wherein said bristles are set in tufts and the length of each row of bristle tufts is approximately two to three times the space between opposite bristle rows.

9. Apparatus as recited in claim 7 wherein the greatest curvature of said bristles occurs at about one-third of the length from the distal extremity and the bristle distal extremities are about at a right angle to the proximal bristle portion, each curved bristle lying approximately in a plane perpendicular to the longitudinal axis of said head.

10. Apparatus as recited in claim 7 wherein the greatest curvature of said bristles occurs at about one-third of the length from the distal extremity and the bristle distal extremities are about at a right angle to the proximal bristle portion, each curved bristle lying approximately in a plane perpendicular to the longitudinal axis of said head.

11. A toothbrush for brushing the buccal and lingual surfaces of teeth comprising an elongated handle, a bristle mounting head formed on the outer end of said handle having a bristle mounting face, at least two rows of curved bristles, the proximal ends of said bristles being mounted in said bristle mounting face, at least some of said bristles having cross sections generally in the shape of a polygon with less than six sides, the curved shape and mounting of said bristles being such that similarly positioned bristles in opposite bristle rows are symmetrically shaped and their distal extremities are nearly touching.

12. Apparatus as recited in claim 11 wherein said bristles are set in tufts and the length of each row of bristle tufts is approximately one and one-half to two times the space between opposite bristle rows.

13. Apparatus as recited in claim 11 wherein the bristles at one end of said bristle rows are longer than others of the bristles.

14. Apparatus as recited in claim 11 wherein said bristle mounting face is substantially planar and further including a row of shorter uncurved bristles between said rows of curved bristles.

15. Apparatus as recited in claim 11 wherein the greatest curvature of said bristles occurs at about one-third of the length from the distal extremity and the distal extremities are about at a right angle to the proximal bristle portion.

16. A toothbrush for brushing the buccal and lingual surfaces of teeth comprising an elongated handle, a bristle mounting head formed on the outer end of said handle having a bristle mounting face, at least two rows of curved bristles, at least some of said bristles having cross sections generally in the shape of a polygon with less than six sides, the proximal ends of said bristles being mounted in said bristle mounting face, the curved shape and mounting of said bristles being such that similarly positioned bristles in opposite bristle rows are symmetrically shaped, the bristles at one end of said bristle rows being longer than others of the bristles and extending a greater distance from said bristle mounting face.

17. Apparatus as recited in claim 16 wherein said bristles are set in tufts and the length of each row of bristle tufts is approximately one and one-half to two times the space between opposite bristle rows.

18. Apparatus as recited in claim 16 wherein said bristle mounting face is substantially planar and further including a row of shorter uncurved bristles between said rows of curved bristles.

19. Apparatus as recited in claim 16 wherein the greatest curvature of said bristles occurs at about one-third of the length from the distal extremity and the distal extremities are about at a right angle to the proximal bristle portion.

* * * * *